US006327981B1

(12) United States Patent
Nørregaard et al.

(10) Patent No.: US 6,327,981 B1
(45) Date of Patent: Dec. 11, 2001

(54) CARRIAGE BODY

(75) Inventors: Kjeld Nørregaard, Silkeborg; Claus Bratsbjerg, Randers; Jens Jørgen Graakjær Jensen, Hinnerup; Ole Nielsen, Randers, all of (DK)

(73) Assignee: DaimlerChrysler Rail Systems GmbH, Berlin (DE)

( * ) Notice: Subject to any disclaimer, the term of this patent is extended or adjusted under 35 U.S.C. 154(b) by 0 days.

(21) Appl. No.: 09/423,886

(22) PCT Filed: May 20, 1998

(86) PCT No.: PCT/DK98/00203

§ 371 Date: Nov. 19, 1999

§ 102(e) Date: Nov. 19, 1999

(87) PCT Pub. No.: WO98/52805

PCT Pub. Date: Nov. 26, 1998

(30) Foreign Application Priority Data

May 20, 1997 (DK) ..... 0577/97

(51) Int. Cl.[7] ..... B61D 17/00

(52) U.S. Cl. ..... 105/396; 105/397; 105/401; 296/181

(58) Field of Search ..... 105/344, 345, 105/423, 396, 397, 401, 422; 296/181

(56) References Cited

U.S. PATENT DOCUMENTS

| | | | | |
|---|---|---|---|---|
| 2,870,723 | * | 1/1959 | Bock et al. | 105/401 |
| 4,319,528 | | 3/1982 | Gutridge et al. | 105/397 |
| 4,995,321 | * | 2/1991 | Ohmura et al. | 105/397 |
| 5,188,039 | | 2/1993 | Ohmura et al. | 105/423 |
| 5,595,123 | * | 1/1997 | Tao et al. | 105/396 |
| 5,613,726 | * | 3/1997 | Hobbs et al. | 296/181 |
| 5,685,229 | * | 11/1997 | Ohara et al. | 105/397 |

FOREIGN PATENT DOCUMENTS

| | | | |
|---|---|---|---|
| 673111 | 12/1978 | (CH) | B62D/23/00 |
| 1580987 | 2/1971 | (DE) | B61D/17/08 |
| 3732086 | 4/1989 | (DE) | B62D/25/00 |
| 0302017 | 1/1989 | (EP) | B62D/27/06 |
| 0302017-A1 | * 2/1989 | (EP) . | |
| 0573384 | 5/1993 | (EP) | B61D/17/04 |
| 0625458 | 4/1994 | (EP) | B61D/17/04 |
| 0644096 | 3/1995 | (EP) | B61D/17/04 |
| 0697318 | 2/1996 | (EP) | B61D/17/04 |
| 8103417 | 2/1984 | (SE) | B62D/21/02 |
| 91/18780 | 12/1991 | (WO) | B62D/31/02 |

* cited by examiner

*Primary Examiner*—S. Joseph Morano
*Assistant Examiner*—Frantz F. Jules
(74) *Attorney, Agent, or Firm*—Ladas & Parry

(57) ABSTRACT

A carriage body for a vehicle is described. It is possible to perform a displacement of a frame element (8) with respect to the outlook through windows (5) from each seat (14) in a train coach. Thus, the frame elements (8) are fastened to the cover plates (3, 4) of the coach above and below the window (5) via grooves (11) in which there are provided connecting means (13) sliding in the grooves (11). Hereby the frame elements (8) may be displaced longitudinally relative to the coach.

11 Claims, 8 Drawing Sheets

CARRIAGE BODY

The present invention relates to a carriage body for a vehicle, preferably a train coach, built up of frame elements and cover plates which together constitute a self-carrying construction imparting strength to the carriage, said cover plates comprising side wall plates, floor plates, and roof plates together with possible windows and forming the casing of the carriage body.

The invention has appeared in connection with development of carriage bodies for train coaches. However, the invention may also be applied for building up carriage bodies for other vehicles, like busses, airplanes and boats.

The invention is primarily intended for building up carriage bodies or a vehicle section to be used for the conveyance of persons, for example compartment sections in train coaches. The advantages achieved by the invention may, however, also be utilised in other vehicle sections intended for carrying loads.

In known carriage bodies for coaches, the construction primarily follows two pre-dominant principles of construction. According to a first principle, a supporting undercarriage is built up. On the undercarriage, there is constructed a frame of the frame elements. When the frame constructions have been made, the cover plates are placed on the frame elements. According to the other principle, the so-called train pipe principle, there is made a self-carrying monocoque construction of cover plates made from metal or composite materials. It is a common feature of the building up of carriage bodies according to these known principles, that the position of the window openings is determined once and for all at the building up of the carriage body.

After making the carriage body, the interior of the coach is arranged. In the known coaches, this arrangement will be dependent on the formed frame construction. Ventilation units, water tanks, and other heavy installations are suspended where reinforced frame elements are provided. Once the coach has been made, it will be very difficult to change it.

During late years, there have been many attempts to make the construction of the train coaches more flexible. For many years, it has thus been desired to make the carriage bodies so that they may be arranged with different seating, for example with the seats in rows or with the seats placed vis-à-vis. It has also been desired to have different seat distances without any of the places becoming worse than others by some seats being placed opposite a window bar and not opposite a window opening.

This is desired as new and increased requirements for comfort are made, and as a result of economic considerations it is desired to re-use existing carriage bodies instead of buying new coaches when there is a change in the need for one or the other type of coaches. It has also been a wish to be able to arrange the carriage body with individual distance between the seats depending on the different wishes expressed in different countries or according to different operating needs.

In order to meet these wishes to a certain degree, it has therefore been proposed to mount rails in the carriage body extending in the longitudinal direction of the coach and which are intended for fastening to the seats. This makes possible an arbitrar, position of the seats in the longitudinal direction of the coach depending on the requirements for seat distance of each operator. Thus, the placing of seats in different positions have been unfavourable as some passengers thereby are placed opposite wall sections between the window openings. A similar problem occurs if, in connection with changed needs, the seat distance is changed, for example from a regional train to an intercity train after some years of operation.

When renovating and changing train coaches ventilation units, light units, etc. are mounted in positions opposite to strong frame elements. It is desired to be able to change the position of such heavy installations in the longitudinal direction of the coach. There is also a need for changing engine installations if the train coach is provided with new and different engines.

SUMMARY OF THE INVENTION

Thus, it is the purpose with the present invention to indicate a construction of a carriage body, especially for a train coach, which makes it possible to fulfil these long-lasting wishes by making possible the production of a flexible carriage body. Especially it is desired to make a carriage body in which it is easy to change the seat arrangement and still keep a free outlook through the windows from all seats, and which at the same time makes it possible to change the positions of heavy installations.

This is achieved according to the present invention with a carriage body of the kind mentioned in the introduction and which is peculiar in that the cover plates comprise junctions provided along the longitudinal extension of the carriage body for mounting the frame elements at arbitrary positions along the carriage body by connecting means which in a detachable way interconnect the frame elements and the cover plates.

The cover plates will typically be made by extrusion, but may also be made by welding together of single plates in the longitudinal direction of the carriage body and are provided with junctions in the longitudinal direction of the carriage body. This makes possible an arbitrary mounting of the frame elements along the carriage body. As the joining takes place by means of detachable connecting means, it will be possible to change the position of the frame elements in the carriage body if a change of the arrangement of the carriage body is desired, or if new load conditions arise.

Both cover elements and frame elements may be made from aluminium, steel as well as sandwich materials, plastic materials (with or without reinforcing fibres) etc., which are suitable for manufacture in consideration of production techniques and strength conditions.

In an existing carriage body, it will thus be possible to remove frame elements from their positions and reposition the frame elements at new junctions on the cover plates. Beside the possibility of the flexible positioning of frame elements in consideration of seating and placing of heavy installations in train coaches, there will be a further advantage at the use of the detachable frame elements.

By varying the position and the number of frame elements in a carriage body, it will be possible to influence dynamic as well as static properties. Thus, it will be possible to use a greater or lesser number of frame elements for adjusting the natural frequency of the carriage body so that no coincidence occurs between the natural frequency of the carriage body and wheel boogies on which the carriage body is suspended. This is important considering the strength conditions and comfort conditions.

The use of the detachable frame elements also provides for a greater freedom in the construction of carriage bodies. Because of the cost of developing new carriage bodies, especially for coaches, it is wished that a single carriage design constitutes the base for a whole family of carriage bodies with different arrangements and purpose. Once a carriage design has been determined so that the construction of the body will fulfil strength conditions, this base concept may be used and supplemented with more frame elements and/or by changing the positions of the frame elements used in the construction of the carriage body. Of course it is a prerequisite that frame elements as well as cover plates are designed to absorb the necessary forces and moments.

The connecting means used between the frame elements and cover plates may be any suitable means making possible a detachable connection. Thus, there may be used screw connections, magnetic connections, adhesive connections that may be dissolved chemically, and hinge connections. Combinations may also be used. Thus, it may be envisaged that a frame element at its one end is provided with a hinge and at its other end it is provided with a screw connection and/or an adhesive connection. Thus, it does not have to be identical connecting means appearing at both ends of the frame elements.

It is preferred that the junctions in the cover plates of the carriage body are provided in the form of grooves extending in the longitudinal direction of the carriage body. Alternatively, it will be possible to use smooth surfaces in case of adhesive connections, or perforated plates extending lengthwise in the carriage body if screw connections are desired. By using perforated plates, the connecting means may comprise expansion bolts to be fastened in the holes of the perforated plate. The perforated plate may be an integrated part of the cover plate itself or may be made as a separate element fastened thereto, e.g. by welding. If the cover plates are sandwich constructions, these may be provided with grooves formed at the making of the cover plates.

If there is used frame elements which are fastened slideably to sections over and under the windows, there may be used an unbroken window ribbon extending in the whole length of a carriage body or a coach section. The frame element extends outside the plane in which the ribbon window is placed and may easily be brought to a new position in the longitudinal direction of the coach if the seating is changed. Therefore, it is possible to arrange the frame element and the seats in such a way that there is a free outlook from all the seats through the windows.

According to an advantageous embodiment, the cover plates are provided in the form of extruded aluminium sections. In such extruded sections the grooves will be created at the extruding itself on the side of the section which in use is intended to face the interior of the carriage body. In this way the frame elements will be placed closely to the cover plates in a position which is directed inwards against the interior of the carriage body.

Alternatively, it will be possible to place the frame elements at the side facing outwards in relation to the carriage body. Such a construction may be possible if it is wished to place cover plates on both sides of the frame elements. However, a carriage body will traditionally be built up with the cover plates facing outwards.

Once the carriage body has been built up, the fitting elements in the form of covering plates, floor strips, edge strips, ceiling sheets, etc. may be placed inside the carriage body and thereby cover the frame elements. In the extruded sections, the grooves will preferably be formed between flanges projecting laterally from the section. The grooves to be used will preferably be C-shaped or T-shaped grooves. Alternatively, it will be possible to use other kinds of undercut grooves.

The connecting means for coupling together the frame element and the cover plates will preferably be T-shaped sectional pieces which may be fastened by means of screw connections. The screw connections extend through the frame element and may therefore be tightened from the interior of the carriage body. The C-shaped sectional pieces will preferably have such a thickness that they may be slided into the opening of the groove and thereafter rotated 90°. Thus, the T-shaped sectional piece may engage the corresponding section in the groove. Using screw connections, it will be simple and easy to assemble the frame elements and the cover plates.

The frame elements may have different shapes. However, it will be important that they are able to absorb a moment. Thus, it is important that a frame element has at least two connecting means that can engage the same groove in a cover plate. Furthermore, it will also be advantageous if each frame element is connected with two grooves in the cover plate.

According to an advantageous embodiment, a frame element has the shape of an I. This element has a stem designed to extend over at least two closely situated cover plates and at the same time has crosswise situated pieces at the bottom and the top. The crosswise situated pieces are arranged so that they may receive connecting means establishing a connection between at least one groove at the top and the bottom of the frame element. In order to absorb the greatest possible moment, the connecting means are placed at each end of the crosswise situated pieces.

The frame elements may be arranged to be oriented in a substantially vertical plane and to be connected with cover plates over and under a ribbon window. This is the primary application of the frame element. The frame element may be disposed vertically or obliquely in the plane parallel with the longitudinal direction of the carriage body.

Alternatively, the frame element may also be arranged for a substantially horizontal orientation for placing in the roof or the floor of the carriage body. This kind of frame element may preferably be provided with means for suspending heavy loads like for example water tanks, ventilation units, waste tanks, engines, and the like. Floor and ceiling sheets will also be mounted on these frame elements.

However, the frame elements in the top or the bottom of the carriage body may also be made without suspension means in order to form just a closed frame element extending in the circumferential direction of the carriage body. This is achieved by providing the frame elements at their ends with coupling means for joining with the ends of corresponding frame elements at the sides of the carriage body. In such a construction, it will be possible to displace a closed frame element by displacing the frame elements singly or together when the carriage body has to be rearranged.

The frame elements will preferably be made by extrusion and have a uniform section throughout their length. In such extruded frame elements used in the sides of the coach, preferably the part of the frame element intended to be placed opposite the ribbon window will be milled away.

Alternatively, the extruded sections may be connected with crosswise placed pieces at their ends in order to establish a connection ideally suited for absorbing moments. Alternatively, it is also possible to use a combination of frame elements of the kind provided with crosswise placed pieces and of the kind which have a uniform section throughout their length. Before the building up of the carriage body, the frame elements will typically be rolled in such a way that they get a desired contour corresponding to the contour of the cover plates to which they are connected. The assembling work itself will therefore be performed very simply and quickly.

The building up of a carriage body will usually take place by using a fixture to affix the mutual positions of the cover plates and the frame elements during the building up. At the rearrangement of a carriage body, it will likewise, in consideration of the stability, be necessary to use a fixture holding the cover plates in place while a frame element is detached and displaced in the longitudinal direction of the coach.

As an alternative to a longitudinal displacement of existing frame elements, it will also be possible to mount new frame elements in the new desired position beside the old frame elements when a carriage body is rearranged. After the new frame elements have been placed in the correct position and fastened, it will then be possible to demount the old frame elements. Such a way for rearranging the carriage body will be quick and simple as there is no need for using fixture when changing the position of the frame elements in the longitudinal direction of the carriage body.

If grooves and rails simultaneously may serve to fasten seats, tables, baggage racks, and like equipment and for fastening the frame elements, there is achieved a very suitable construction. However, it will be a requirement that such connecting grooves or connecting rails are to be dimensioned to absorb the necessary forces occurring in the carriage body.

The frame elements forming a part of the carriage body according to the invention, may be used for different purposes and in different situations of use if only they are dimensioned and designed with respect to this. The frame elements may thus be used as strengthening elements between upper and lower parts of a carriage body, as strengthening elements between one and the other side of the carriage body, as strengthening element around external openings like e.g. door or ventilation openings. Hereby the frame elements may be used as places for mounting movable or affixed equipment in the casing of the carriage body like e.g. ventilation grids and doors.

The frame elements may furthermore be used as strengthening element at the ends of the carriage body. Hereby the frame element makes possible the fastening of end elements of the carriage body, like gables, front systems and coupling elements. This use of the frame elements will make possible that such end elements for the carriage body may be mounted or detached throughout the lifetime of the carriage body with the purpose of repair, improvement, and possibly adjustment to new conditions in infra-structures.

As it appears from the above-mentioned areas of use, a very flexible rearrangement of a carriage body will be possible. With a limited effort the carriage body may thus be adjusted or changed in the height, the length, and/or the width. At the same time the frame elements may be placed so that in carriage bodies for transportation of persons it may always to be possible to establish a free outlook through a ribbon window irrespective of the seating arrangement and/or the distance between the seats.

In suitable embodiments of the frame elements, these may be prepared for the fastening of e.g. chairs, tables, toilets, bicycle racks, and baggage racks, etc. The frame elements may in this respect be designed with suspension means for such interior equipment in the same way as they may be provided with suspension means for suspending heavy loads.

Besides the above advantages, the carriage body according to the invention will furthermore be advantageous at removal. When a carriage body is not to be used anymore, it will easily be disassembled and many elements from the carriage body may be reused. Alternatively, it will be easy to remove the single parts of the carriage body with the purpose of recirculating the material in separated form.

BRIEF DESCRIPTION OF THE DRAWING

The invention will be explained hereafter with reference to the attached schematic drawing in which.

DETAILED DESCRIPTION OF THE PREFERRED EMBODIMENTS

Figure 1:
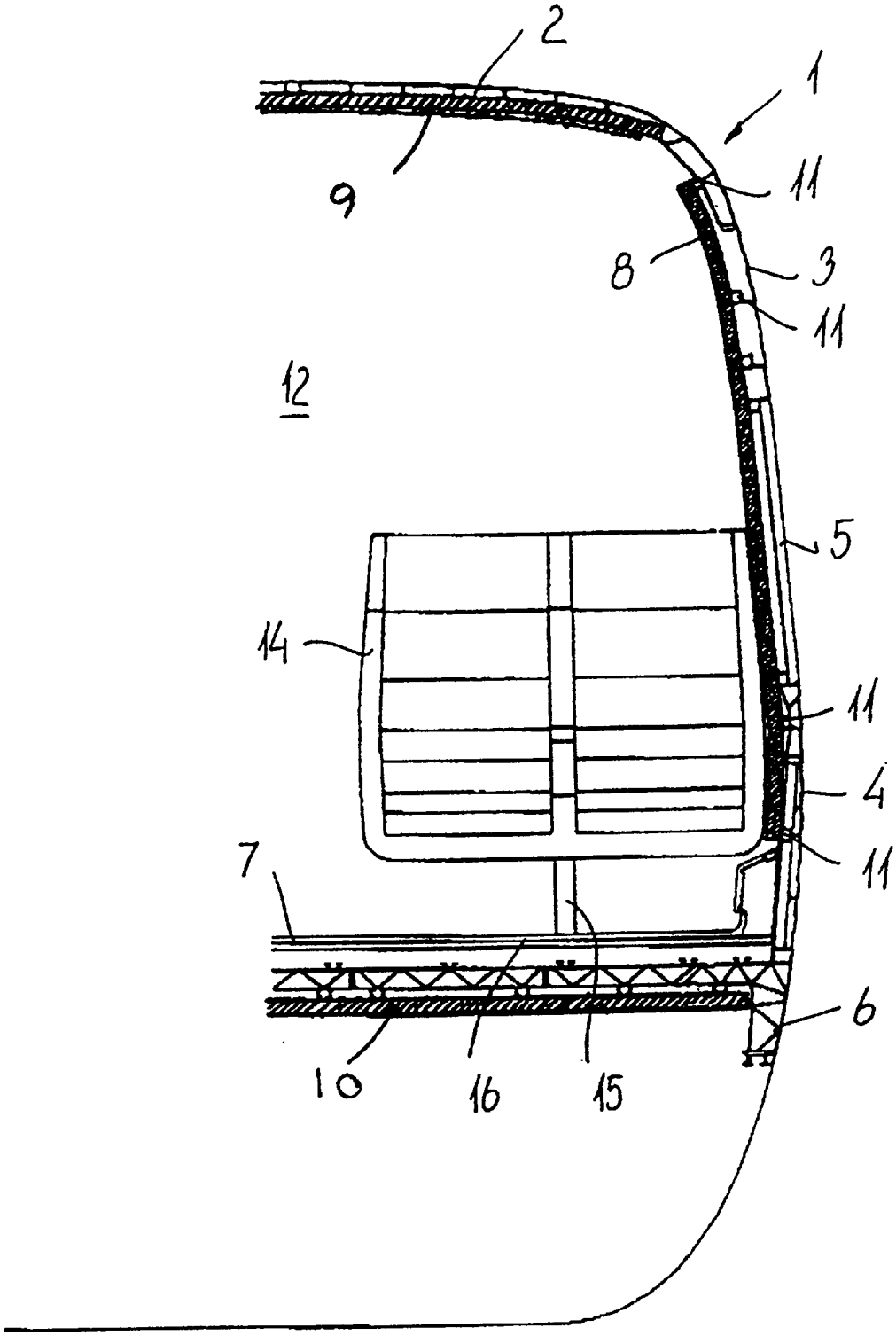
FIG. 1 shows a partial section through a train coach according to the invention.

In FIG. 1, there is seen a carriage body in the shape of a train coach 1. For the sake of clarity, there is only shown the elements necessary for explaining and understanding the invention. The coach 1 will thus comprise several elements as for example front piece, wheel sets, ventilation units, toilet compartments, doors, etc. The coach 1 comprises cover plates in the shape of roof sections 2 and side wall sections 3,4 over and under a window section 5. Furthermore, the carriage body comprises cover plates in the shape of bottom sections 6 and floor sections 7. The cover plates are mutually connected by means of frame elements 8,9 and 10. The frame elements 9 and 10 are in the shown embodiment of the traditional kind, whereas the frame element 8 connecting the side wall sections 3 and 4 with each other, is designed in accordance with the present invention.

The cover plates are made of extruded sections with a length corresponding to the length of the formed coach. The window 5 is made as an unbroken ribbon window which also extends in the whole length of the coach. The ribbon window may possibly be composed of a number of window elements which are only divided by a narrow connecting joint.

The side wall sections 3 and 4 are provided with grooves 11. These extend along the whole length of the side wall section and extend thus in the longitudinal direction of the coach. The grooves 11 may be produced on the side of the cover plate which in use is intended to face the interior 12 of the coach. The grooves 11 may alternatively be produced on the side of the cover plate intended to face away from the interior 12 of the coach. As the sections preferably are extruded aluminium sections, the grooves will be created at the extrusion. Alternatively, they may be milled grooves.

Figure 11:
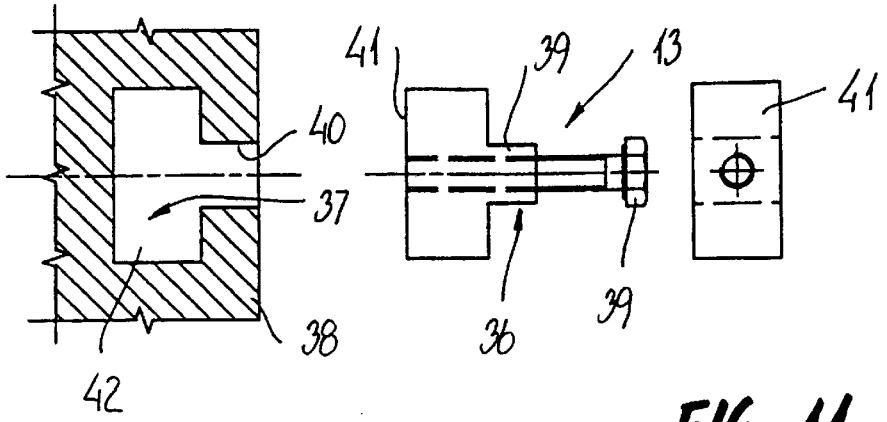
FIGS. 11–13 are three different embodiments for connecting means for mutual fastening of frame elements and cover plates.
Figure 12:
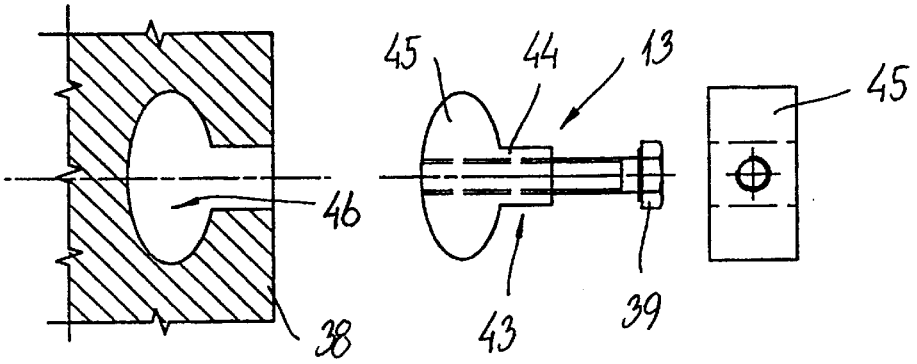
Figure 13:
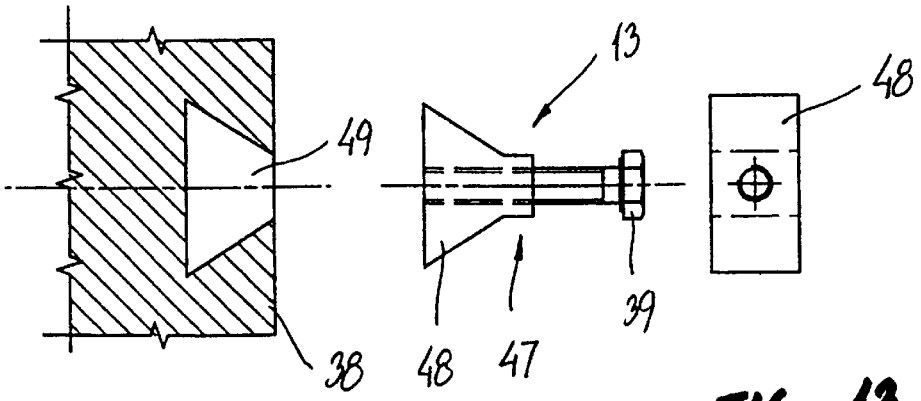

The frame elements 8 are mounted in arbitrarily chosen positions along the grooves 11 by means of connecting means 13 (see also FIGS. 11–13). The connecting means 13 may be tightened and loosened so that a longitudinal displacement of the frame elements 8 is possible in relation to the side wall sections 3,4.

Figure 2:
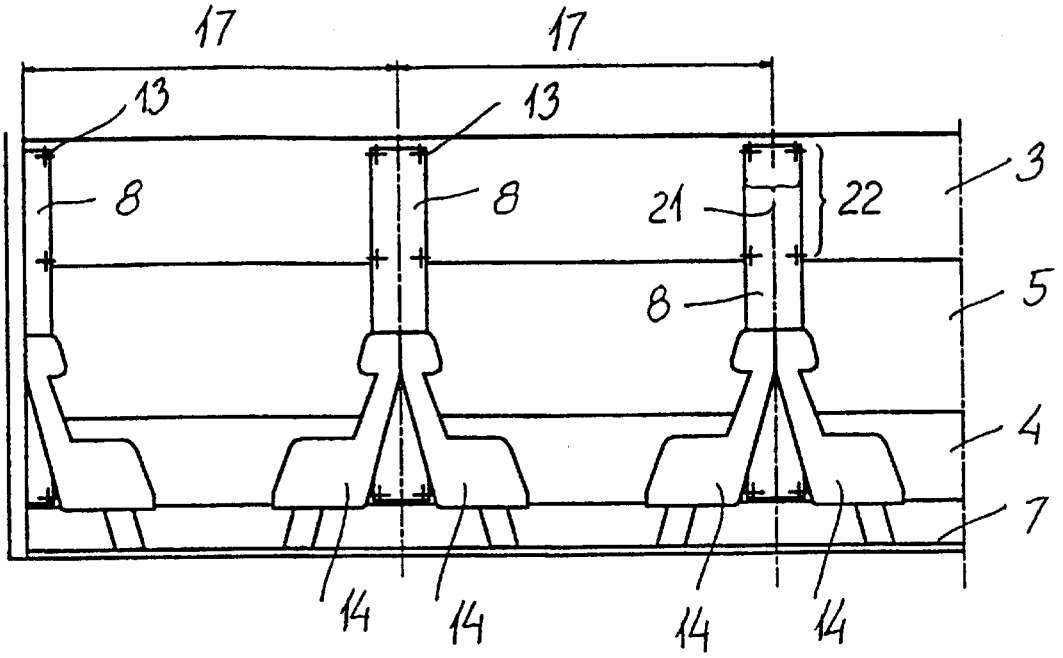
FIGS. 2–3 are partial views for illustrating different arrangements of seats in a coach according to the invention.

In the shown embodiment, the coach 1 has seats 14 arranged in a vis-à-via arrangement. The seats 14 are via a leg 15 mounted in a rail 16 in the floor section 7 of the coach. This makes it possible to slide the seats in the longitudinal direction of the coach. Hereby it is possible to arrange the seats 14 with a mutual distance 17 as shown in FIG. 2. In the shown configuration, the frame elements 8 are placed opposite to two seats 14 which are arranged back to back. Hereby the passengers will have a free outlook through the window 5.

Figure 3:
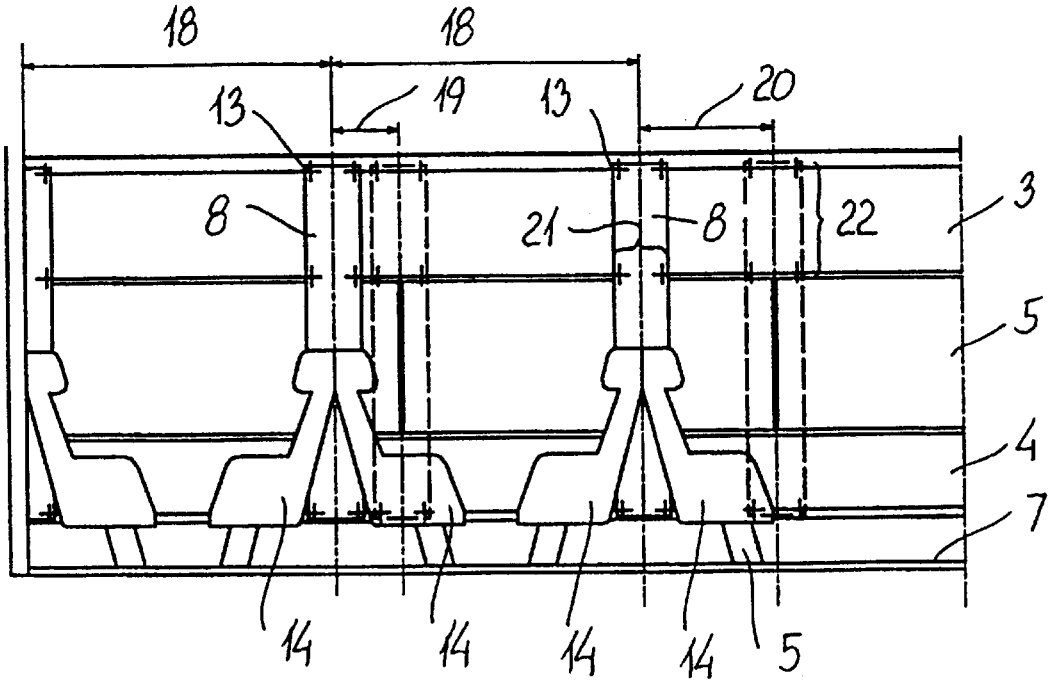

By means of the connecting means 13, the frame elements 8 are fastened in the grooves 11 in the side wall sections 3,4 which are over and under the unbroken ribbon window. Hereby the carriage body achieves its necessary rigidity while at the same time the use of actual window bars is avoided. This makes possible a change of the mutual distance between the seats as shown in FIG. 3 while at the same time the frame elements 8 may be displaced to a position opposite the seats 14. When the seat distance, as illustrated in FIG. 3, is reduced to a new distance 18, the frame elements 8 will also be displaced. The frame elements 8 will thus be displaced in a distance 19 or a multiple of this distance 20. Hereby passengers in all seats will have a free outlook without inconvenient window bars in the field of sight.

As illustrated in FIGS. 2 and 3, connecting means 13 intended for mounting in the same groove 11 are disposed with a mutual distance 21. Likewise, a distance 22 between two adjoining grooves 11 occurs. This ensures torsional stability so that the frame elements give the coach the necessary rigidity.

Figure 4:
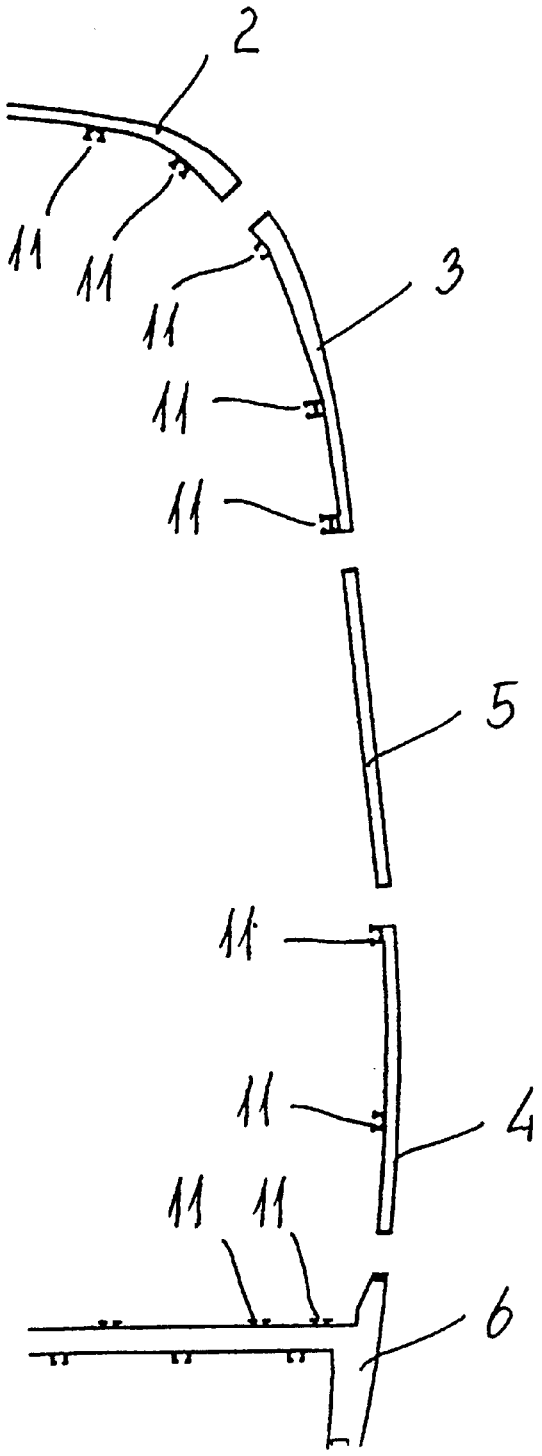
FIG. 4 is a partial section for illustrating cover plates and windows for a coach according to the invention.

FIG. 4 shows a partial section for illustrating the different cover plates which with the window 5 are intended to form the casing of the carriage body. In the shown embodiment, there is created grooves 11 on all roof sections 2, side wall sections 3,4, and floor sections 6.

All cover plates are thus intended to be joined by means of frame elements 8 or corresponding frame elements placed at the interior 12 of the coach. Alternatively, it will be possible to place the grooves 11 at the side facing outwards so that the frame elements are situated at the external side of the cover elements. However, it is preferred to place the frame elements 8 inwards relative to the cover plates and subsequently to place fitting elements in the interior of the coach.

Figure 5:
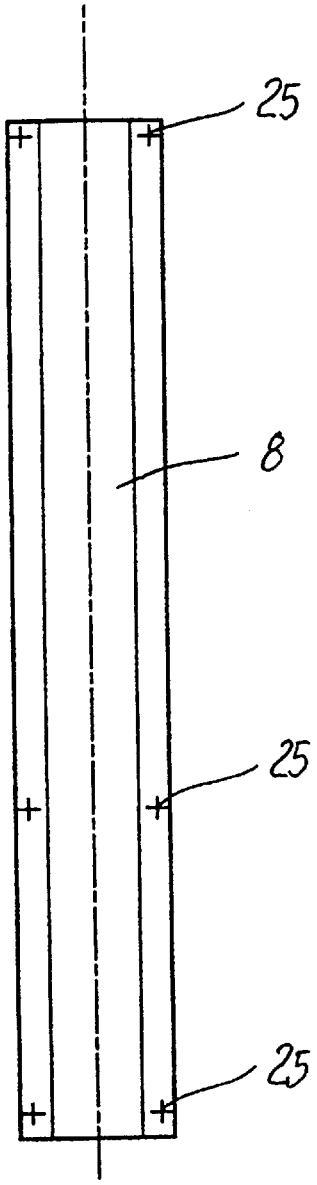
FIGS. 5–7 are three views for illustrating a first embodiment of a frame element.
Figure 6:
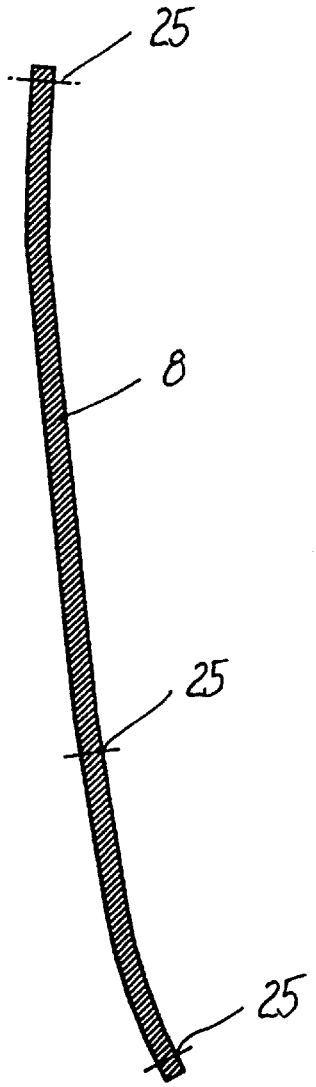
Figure 7:
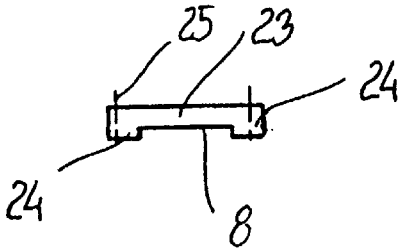

FIGS. 4,5 and 6 show views for illustrating a frame element 8 of the kind shown in FIGS. 1–3. The frame element 8 is formed by an extruded aluminium section which subsequently is rolled to get a curved form as shown in FIG. 6, and which corresponds to the actual section of the coach. It appears from the end view in FIG. 7 that the section 8 has a central groove 23 extending in the longitudinal direction of the section. The section thus appear with two projecting side parts 24 which are advantageous with respect to strength and moment absorption. In the section 8, there is created throughgoing borings 25 serving to receive the connecting means 13.

Figure 8:
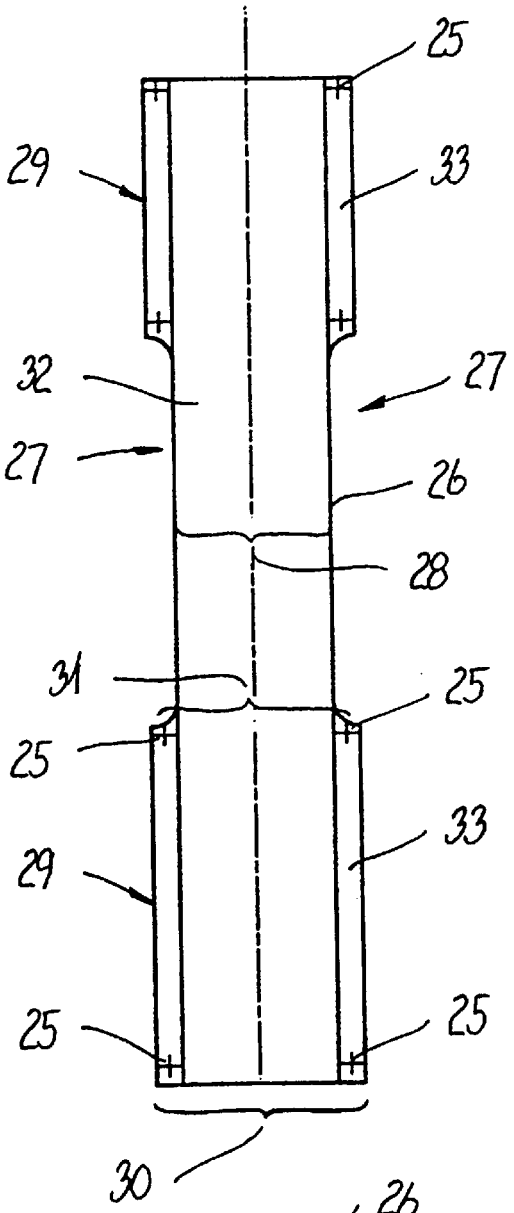
FIGS. 8–10 are three views for illustrating a second embodiment of a frame element.
Figure 9:
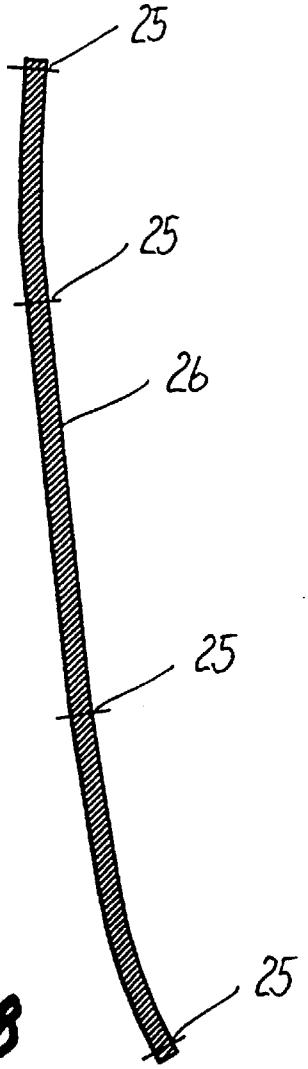
Figure 10:
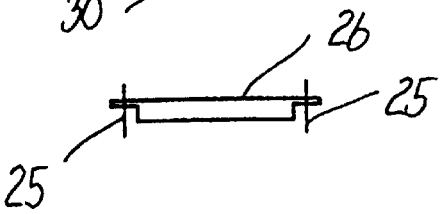

In FIGS. 8–10, there is shown a second embodiment of a frame element 26 according to the invention. In this frame element certain parts 27 of the extruded section 26 are removed. Hereby the frame element will have a relatively small width 28 in the area which is at the window 5, hereby extending the field of sight as much as possible. At the same time, the end parts 29 of the section intended to be placed at the side wall sections 3,4 will have a greater width 30 so that the borings 25 for receiving the connecting means may have a sufficiently great mutual distance 31 in order to ensure a torsionally stable construction.

Thus, it may be said that the frame element 26 substantially has the shape of an I-element with a stem 32 having a length so that it extends over at least two closely situated cover plates, and which at its bottom and top has crosswise faced pieces 33 for receiving the connecting means 13.

Figure 17:
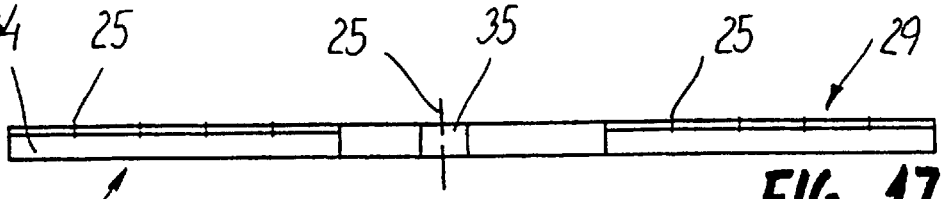
Figure 18:
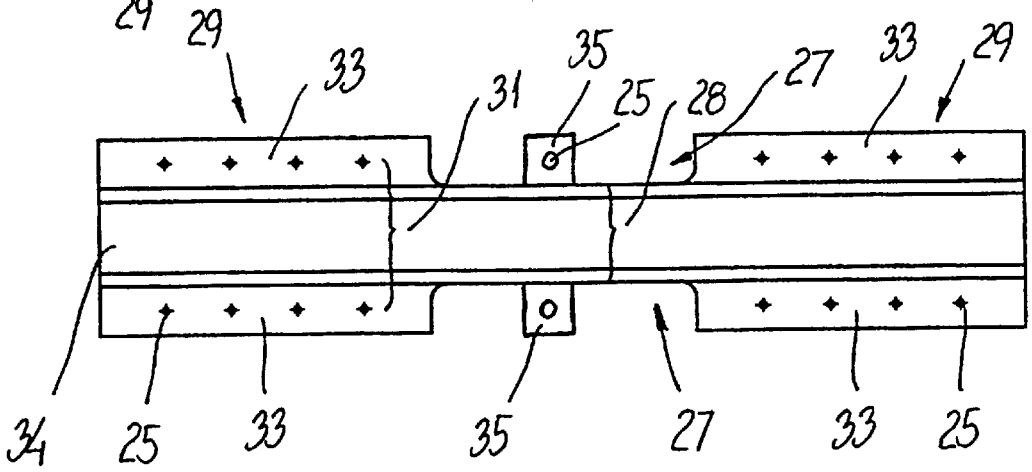

The shown frame elements 8,26 are preferably intended to be used in a vertical orientation and to be connected with the side wall sections 3,4 over and under the window 5. However, the frame elements may also be arranged to be placed in the floor or the ceiling with a substantially horizontal orientation. An example of such a frame element 34 is shown in FIGS. 17 and 18.

The frame element 34 differs from the frame element 26 by being provided with further connecting means 35 in the shape of fastening pieces which serve to suspend heavy loads like water tanks, ventilation units, waste tanks, engines, and the like, depending on whether the frame element 34 is applied in the roof or the floor of the coach.

In the FIGS. 11–13, there is shown 3 different embodiments for the connecting means 13.

In FIG. 11, there is shown a connecting means with a T-shaped sectional piece 36 intended to engage a T-shaped groove 37 formed in one of the cover plates 38 of the carriage body. The T-shaped sectional piece 36 may be fastened by means of a screw 39 intended to extend through one of the holes 25 in a frame element (not shown). The fastening piece 36 has a stem 39 intended to be received by an opening 40 of the groove 37, and a cross branch 41 intended to be received in a bottom part 42 of the groove 37.

In FIG. 12, there is shown another embodiment of a connecting means 13. This comprises a sectional piece 43 with a stem 44 and a circular head 45. The circular head 45 is intended to engage the bottom of a C-shaped groove 46 in a cover plate 38.

In FIG. 13, there is shown a further embodiment of a connecting means 13. This comprises a fastening piece 47 having a substantially triangular head 48 which is intended to engage a triangular groove 49 in the cover plate 38. Thus, there is created a joint that may be compared to a dovetail connection.

Figure 14:
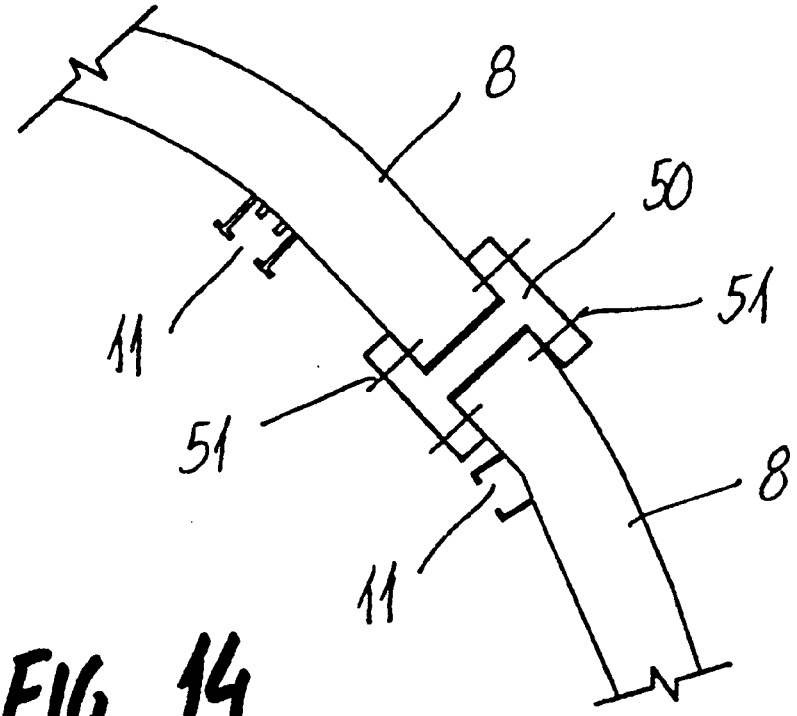
FIG. 14 is a partial view for illustrating a connection between the ends of two frame elements.

In FIG. 14, there is shown a partial view of the ends of two frame elements 8. The frame elements 8 are connected to each other via a connecting piece 50 fastened to the frame elements 8 by means of screw connections 51.

Figure 15:
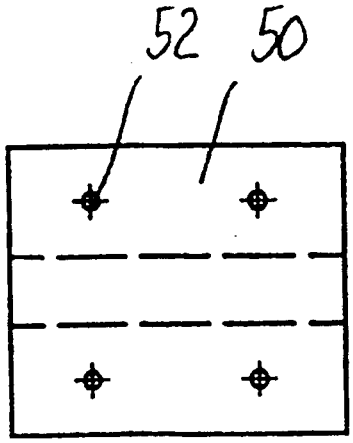
FIGS. 15 and 16 are two views for illustrating the connection piece shown in FIG. 14, and FIGS. 17 and 18 are two views for illustrating a third embodiment of a frame element for a carriage body according to the invention.
Figure 16:
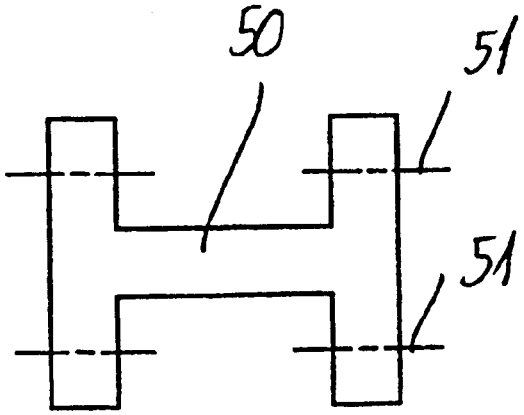

FIGS. 15 and 16 show the connecting piece 50 with a substantially H-shaped form. The connecting piece 50 is provided with a number of openings 52 for receiving screws (not shown) for creating a screw connection extending through the openings 52 of the connecting piece 50 and corresponding openings in the ends of the frame elements 8. By joining the frame elements end to end, there is created a substantially closed frame element extending in the whole circumference of the carriage body.

By rearranging the construction of a coach, it will thus be possible to use a greater or lesser number of closed frame elements which are placed in a desired distance lengthwise of the coach. The frame elements which are interconnected by means of the connecting piece 50 may be intended to be placed in the side, the bottom, or the top of a formed carriage body. Such a closed frame element may for example be used at the ends of the carriage body and may be designed especially with the purpose of fastening fronts, etc.

What is claimed is:

1. A carriage body for a vehicle, built up of frame elements and cover plates which together constitute a self-carrying construction imparting strength to the carriage, the cover plates comprise side wall plates, floor plates and roof plates together with possible windows and form the casing of the carriage body, wherein the cover plates comprise junctions provided along the longitudinal extension of the carriage body for mounting the frame elements at arbitrary positions along the carriage body by connecting means which in a detachable way interconnect the frame elements and the cover plates.

2. A carriage body according to claim 1, wherein the junctions are provided as grooves extending along the longitudinal extension of the carriage body over at least one of the cover plates.

3. A carriage body according to claim 1, wherein the cover plates are extruded aluminum sections and that the grooves are extruded grooves.

4. A carriage body according to claim 3, wherein the grooves are formed between flanges projecting from the sides of the extended aluminum sections, the grooves preferably having C-shaped or T-shaped sections, and that the connecting means comprise T-shaped or mushroom-shaped clamping means for mounting in the grooves, and which may be fastened by means of screw connections extending through the frame elements.

5. A carriage body according to claim 1, wherein the frame elements are shaped with a contour corresponding to the contour of the cover plates to which they are connected.

6. A carriage body according to claim 1, wherein the frame elements are substantially I-shaped elements, each having a stem arranged for extending over at least two closely situated cover plates and having a crosswise arranged piece at each end, the frame elements being arranged to be joined with the junctions of the cover plates at each of the ends, and that there are provided connecting means at each end of the crosswise arranged pieces.

7. A carriage body according to claim 1, wherein the frame element is arranged in a mainly vertical plane which is parallel with the longitudinal extension of the carriage body and connected with side wall sections over and under a ribbon window.

8. A carriage body according to claim 7 wherein said frame element is vertically oriented within said mainly vertically plane.

9. A carriage body according to claim 7 wherein said frame element is obliquely oriented within said mainly vertical plane.

10. A carriage body according to claim 1, wherein the frame element is arranged in a substantially horizontal plane in parallel with the longitudinal extension of the carriage body and placed in the roof or the floor of he carriage body, and that it is provided with means for suspending heavy loads like water tanks, ventilation units, waste tanks, engines, and the like.

11. A carriage body according to claim 1, wherein the junctions of the cover plates are surfaces, that the frame elements have corresponding surfaces, and that the connecting means comprise adhesive connections which fasten and in a detachable way interconnect the frame elements and the cover plates.

* * * * *